United States Patent [19]

Marsden et al.

[11] Patent Number: 4,983,504

[45] Date of Patent: Jan. 8, 1991

[54] METHOD AND APPARATUS FOR PROCESSING PHOTOGRAPHIC COLOR MATERIALS

[75] Inventors: Peter D. Marsden, North Harrow; John R. Fyson, Hackney; Peter J. Twist, Lee Common, all of United Kingdom

[73] Assignee: Eastman Kodak Company, Rochester, N.Y.

[21] Appl. No.: 313,107

[22] Filed: Feb. 21, 1989

[30] Foreign Application Priority Data

Feb. 26, 1988 [GB] United Kingdom ..... 8804606

[51] Int. Cl.[5] ..... G03C 7/00; G03C 7/30

[52] U.S. Cl. ..... 430/398; 430/399; 430/434; 430/464; 430/467; 430/490

[58] Field of Search ..... 430/372, 434, 464, 398, 430/399, 405, 467, 490

[56] References Cited

FOREIGN PATENT DOCUMENTS 147148 7/1985 European Pat. Off. .
2554935 5/1985 France .
62-52549 3/1987 Japan .

OTHER PUBLICATIONS

Derwent Abstracts, "Continuous Treatment. . . ", 6/83, J58 095342, Konishiroku.
Derwent Abstracts, "Automatic Developing Machine. . . ," 6/86, J61 134759, Konishiroku.

*Primary Examiner*—Paul R. Michl
*Assistant Examiner*—Patrick Doody
*Attorney, Agent, or Firm*—Robert A. Linn

[57] ABSTRACT

A method for processing photographic silver halide color negative film and color negative paper each through its own color developing solutions wherein the paper color developing solution is replenished and the overflow from this replenished solution is used to replenish the film color developing solution and wherein (a) the color paper is based on substantially pure silver chloride emulsions and contains no more than 1% molar silver bromide based on total silver halide and (b) both color developing solutions and the replenisher are free from benzyl alcohol.

Apparatus for carrying out the above-described method comprises a series of processing stations and means for advancing the photographic material being processed through the apparatus wherein there is provided means for collecting the overflow from the paper developer station and means for passing it directly or indirectly to the film processing station.

12 Claims, 4 Drawing Sheets

C41 SEASONING RUN (REPLENISHER FROM PAPER OVERFLOW)

CONTROL PLOT

METHOD AND APPARATUS FOR PROCESSING PHOTOGRAPHIC COLOR MATERIALS

FIELD OF THE INVENTION

The invention relates to a method of processing photographic color negative materials and to apparatus therefor.

BACKGROUND OF THE INVENTION

The processing of photographic color negative films and the making of prints on color negative paper is customarily carried out either at a processing laboratory or, latterly, in a minilab.

The industry standard processes use the color developing agent 4-N-ethyl-N-(2-hydroxyethyl) amino-3-methyl-aniline sulphate (CD4) as the sole color developing agent for the film and 4-N-ethyl-N-(2-methanesulphonamidoethyl)amino-o-toludine sesquisulphate (CD3) as the sole color developing agent for the paper.

French Patent No. 2 554 935A1 describes a method of shortening the paper development time by combining the developing agents CD3 and CD4 wherein the CD4 acts as a development accelerator.

A number of the components of photographic processing solutions are consumed during processing and it is conventional to add a replenisher to the solutions to maintain their performance. A common procedure is to add a fixed amount of replenisher solution to, say, a color developer solution per square meter of photographic material processed. Usually the replenisher is mixed into the bath and any excess solution overflows to waste.

Japanes Kokai No. 62-52549 describes a processing system that has facilities for processing two types of silver halide color photographic materials, each through its own processing solutions wherein one of the color developing solutions is replenished and this replenished solution is used as the replenisher for the other color developing solution. Only one system is specifically described and this comprises using a standard color paper developer based on CD3 and containing benzyl alcohol. This paper developer is replenished and the replenished paper developer is fed to the film color developer which is also based on CD3 and contains benzyl alcohol. The color paper being processed is based on silver chlorobromide emulsions.

This system is unsatisfactory for a number of reasons. First, the dyes produced in the color film will not have the same spectral absorptions as they would have had when processed in the standard CD4 film developer. Hence, general use of such a process would mean that all the negative films of all manufacturers would probably need to be reformulated—an almost unthinkably expensive task. Further, the use of benzyl alcohol in the film developer would lead to the formation of tar often associated with CD3 paper developers. Moreover the Kokai does not described any substantial advantages over and above the slight savings associated with the use and mixing of a single developer replenisher rather than two.

SUMMARY OF THE INVENTION

The present invention relates to a method of color processing both film and paper in which the color paper is based on substantially pure silver chloride emulsions and wherein both color developers are free from benzyl alcohol. Such a method leads to a number of important advantages as will be described below.

According to the present invention there is provided a method of processing photographic silver halide color negative film and color negative paper each through its own color developing solutions wherein the paper color developing solution is replenished and the overflow from this replenished solution is used to replenish the film color developing solution and wherein (a) the color paper is based on substantially pure silver chloride emulsions and contains no more than 1% molar silver bromide based on total silver halide and (b) both color developing solutions and the replenisher are free from benzyl alcohol.

DESCRIPTION OF THE PREFERRED EMBODIMENTS

Figure 1:
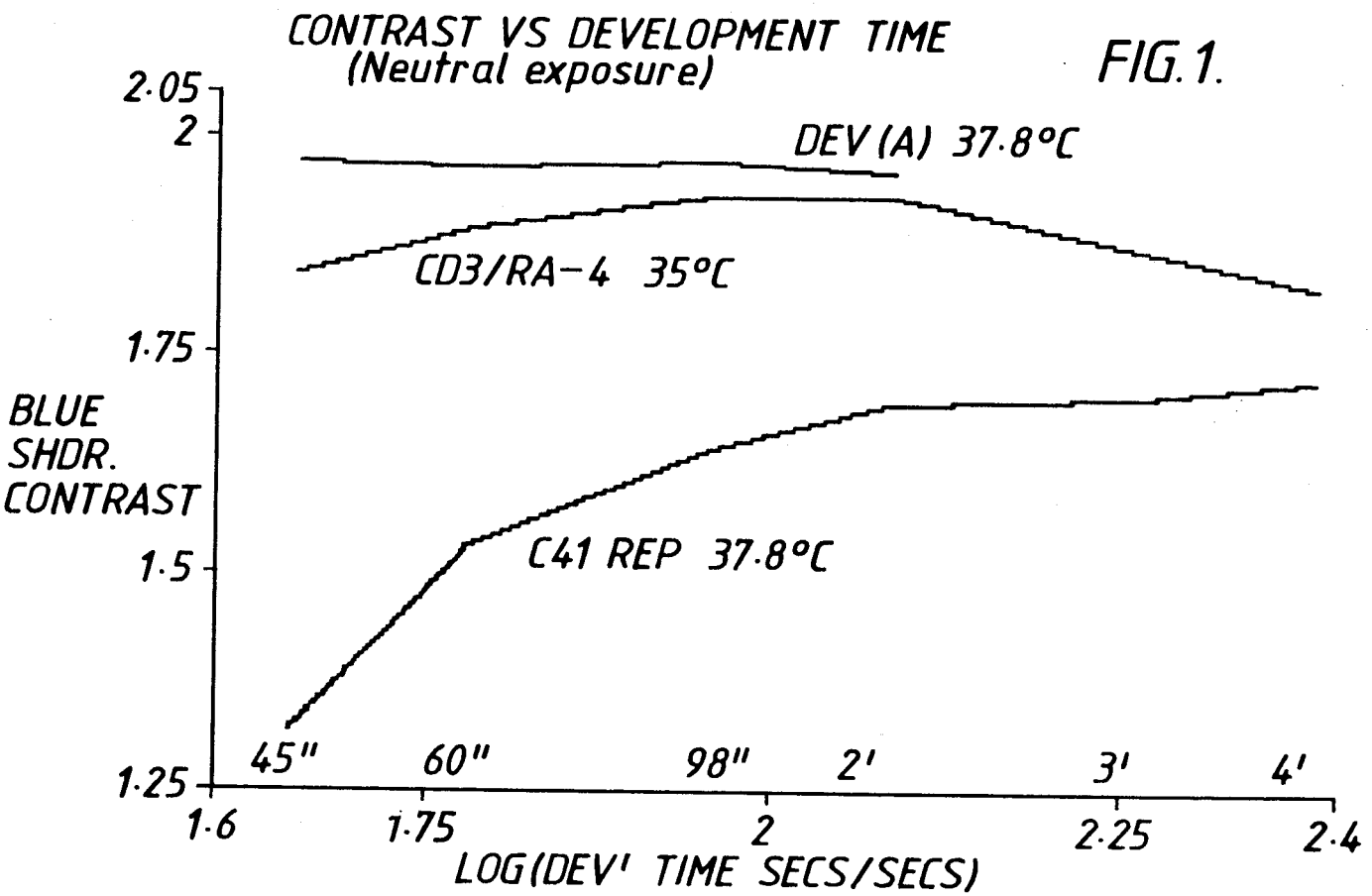
FIGS. 1 and 2 show a development/time plot for the blue record of a neutral exposure on color paper for the method of this invention.

Preferably the film and paper developers contain the same color developing agent or mixture of color developing agents, preferably as the sole color developing agent. The preferred color developing agent is CD4 (identified above).

Because of the different requirements of film and paper developers it is necessary to formulate the paper developer in such a way that its overflow solution is suitable for use as a film developer replenisher. It is expected that in many cases further replenisher components will have to be added to the paper developer overflow before it is added to the film developer. Preferably however, no such additions need be made.

The present invention enables the production of processed film and paper of fully acceptable standards in respect of sensitometry. This is particularly surprising because, using the preferred color developing agent CD4 previously not used for color paper, satisfactory dye hues are obtained and higher dye density per mole of silver halide is produced actually leading to potential savings of silver halide in the paper. There may be some loss of stability of the image dyes in the print but this could be improved by treatment with a stabiliser during processing and/or by incorporating a stabiliser in the color paper. In addition remarkably fast developing times can be achieved for the color paper—something which is not achievable with a CD3 solution containing benzyl alcohol. Furthermore, the formation of tarry deposits typical of developers which contain benzyl alcohol are completely eliminated. Finally, it is possible to run the system in a way which reduces the volume of effluent to be disposed of.

The present method of replenishment also reduces the number of parts in the processing chemical kit thus saving on handling and storage costs. Further savings can be made in chemical costs and amount of solution sent to waste.

In conventional systems, the film replenisher is made up in bulk and added to the system when required. There is no check on its quality and if it deteriorates during storage the first sign of this will be that the film developer is performing badly. This is serious because once a film is developed no second attempt is possible (unlike making prints where reprinting is both possible and easy). A further advantage of the present method is that the quality of the paper developer and hence its overflow can be monitored, e.g. by using paper test strips, and if out of specification can be rejected rather than used as film replenisher.

In a preferred embodiment the paper developer solution and the replenisher contain little or no bromide ions. The advantage of this is that the replenishment rate of the film developer can be reduced since less bromide is lost at such a rate while color developer replenishment is still adequate. Clearly a lower replishment rate leads to less effluent and this is advantageous for ecological reasons. Preferably then, the paper developer contains less than 0.7 g/1 bromide (as sodium bromide).

The nature of the films and papers to be processed may, within the constraints of the present invention, vary widely. Color negative materials and their possible constituents are, for example, generally described in Research Disclosure, Dec. 1978, Item 17643, published by Industrial Opportunities Ltd., The Old Harbourmaster's, 8 North Street, Emsworth, Hants P010 7DD, UK.

EXAMPLES

The following Examples are included for a better understanding of the invention.

Example 1

Samples of a color negative paper whose emulsions are of the type described in U.S. Pat. No. 4,269,927 which comprise substantially pure silver chloride and which contain less than 1% molar silver bromide based on total silver halide were exposed to a 0.15 logE step wedge (R, G, B, and neutral exposure) and were then developed for a range of development times (45", 60", 90", 2min, 3min, 4min at 38° C.) in the developer solution (A) based on CD4 shown in Table 1. The remainder of the process consisted of the conventional EP2 bleach-fix 60 seconds 38° C., followed by a wash (60 seconds). After drying, H and D plots were made at each development time. Two further development time series were carried out using as the developers (a) Film C41 replenisher and (b) the standard RA-4 CD3 developer designed for the paper.

TABLE 1

| Component Necessary | (A) | Additions | C41 REP |
|---|---|---|---|
| Hydroxylamine sulphate (HAS) | 2.0 | 0.80 | 2.80 |
| Sodium metabisulphite | 0.44 | 3.02 | 3.46 |
| CD4 | 4.00 | 1.25 | 5.25 |
| KODAK Anti-Calcium No.8 (AC8) | 3.25 | 3.25 | 6.5 |
| KBr | 0.16 | 0 | 0 |
| NaBr | 0 | 0.76 | 0.90 |
| Potassium carbonate | 28.0 | 9.5 | 37.5 |
| KODAK EKTAPRINT 2 Stain Reducing Agent (SRA)* | 2.3 | (0.0) | 2.3 |
| pH | 10.03 (27° C.) | | 10.06 (27° C.) |

*The addition of SRA to the paper formula (A) is necessary to reduce stain. No detrimental effect has been observed on the film developer.

It is seen from Table 1 that by adding the chemicals shown under "Additions", formula (A), the C41 Film replenisher formula close to standard C41 but containing SRA is arrived at. In principle the formula for the paper developer could be used to make the Film replenisher solution. The exact amount of additional chemicals that need to be added would depend on the equilibrium conditions arrived at in the (paper) tank when a suitably designed paper developer replenisher is used at a pre-determined replenishment rate in a continuously operating processor.

Figure 2:
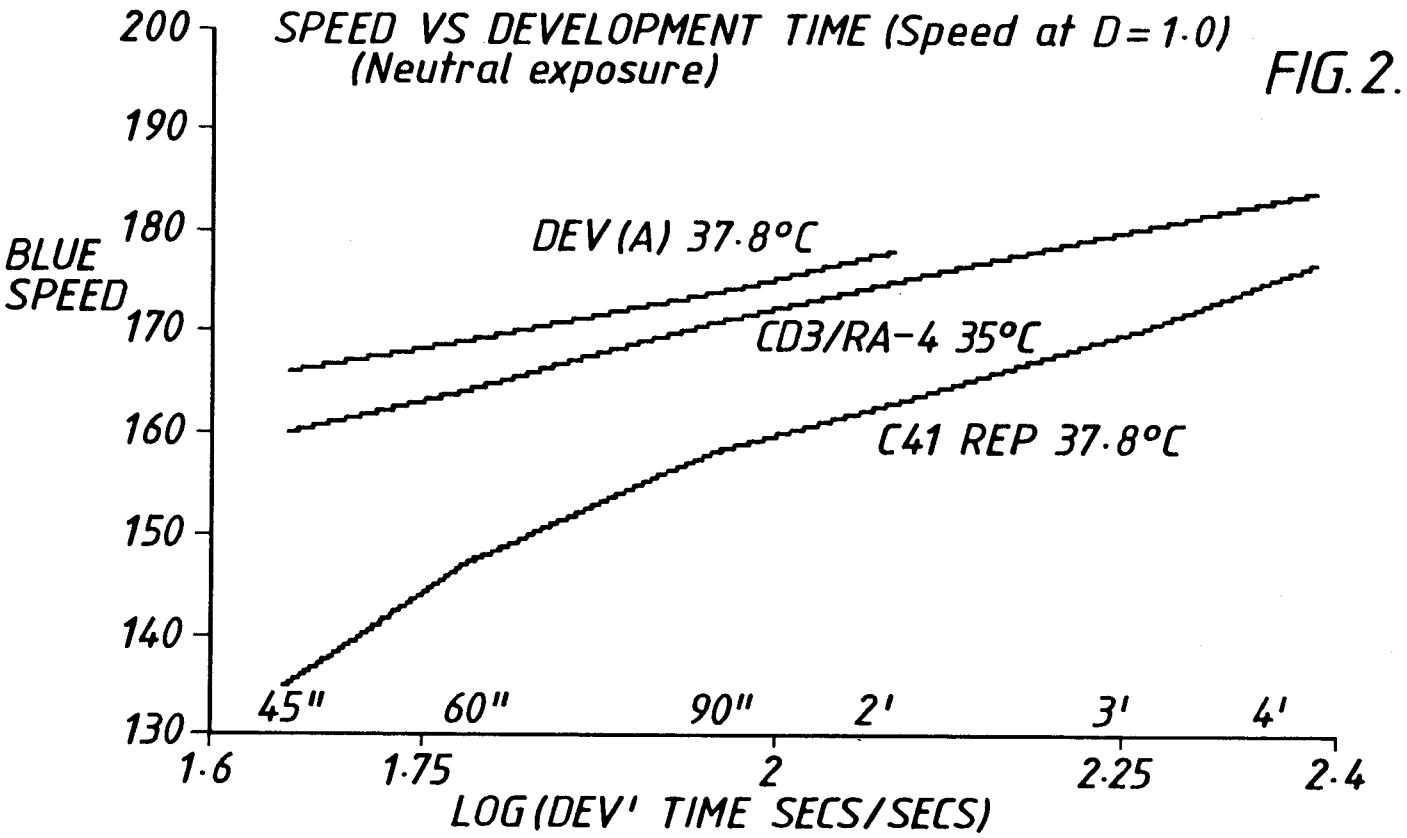

For rapid access, the paper development time must be kept as short as possible while maintaining acceptable speed and contrast. Normally it is the development of the yellow layer which is rate controlling. FIGS. 1 and 2 show a development/time plot in terms of shoulder contrast and speed plotted for the blue record of a neutral exposure on the Color Paper derived from the development time series. Rapid development is observed for developer (A) when compared with the C41 replenisher (used as a paper developer) and is equal to the performance of the Paper in the standard Process RA.4 Developer (based on CD3 and labelled as CD3/RA-4 in FIGS. 1 and 2). The cyan and magenta layers are very rapid to develop and present no problem. The neutral sensitometry at 45 seconds development 38° C. in developer (A) is very similar to the sensitometry for the same paper at the same exposure developed in the optimized standard process RA-4 developer for 45 seconds (but at 35° C.). Generally, more speed and contrast is observed with the CD4 based developer (A).

Example 2

Process modelling work allowed an estimate of the replenisher formulation for developer (A) to be made. This was modified on the basis of analytical data from a seasoning run to give the formula in Table 2.

TABLE 2

| Developer (A) Replenisher | |
|---|---|
| Component | Concentration g/1 |
| Hydroxylamine sulphate HAS | 3.0 |
| $K_2SO_3$(anhydrous) | 1.1 |
| CD4 | 5.28 |
| NaBr | 0.15 |
| SRA | 2.3 |
| AC8 (ml) | 6.5 |
| pH | 10.15 |

A seasoning run equivalent to 20% usage in typical conditions over 5 weeks was undertaken by processing for 1.6 hours per day with the machine switched on for 8 hours a day. The paper was the same as that used in Example 1 and the replenishment rate was 215 ml/m$^2$.

| | Time | Temperature |
|---|---|---|
| Developer | 47 seconds | 37.8° C. |
| Bleach-fix | 44 seconds | 33.0° C. |

-continued

| | Time | Temperature |
|---|---|---|
| Wash | 90 seconds | 32.0° C. |
| Dry | 60 seconds | 75.0° C. |

Figure 3:
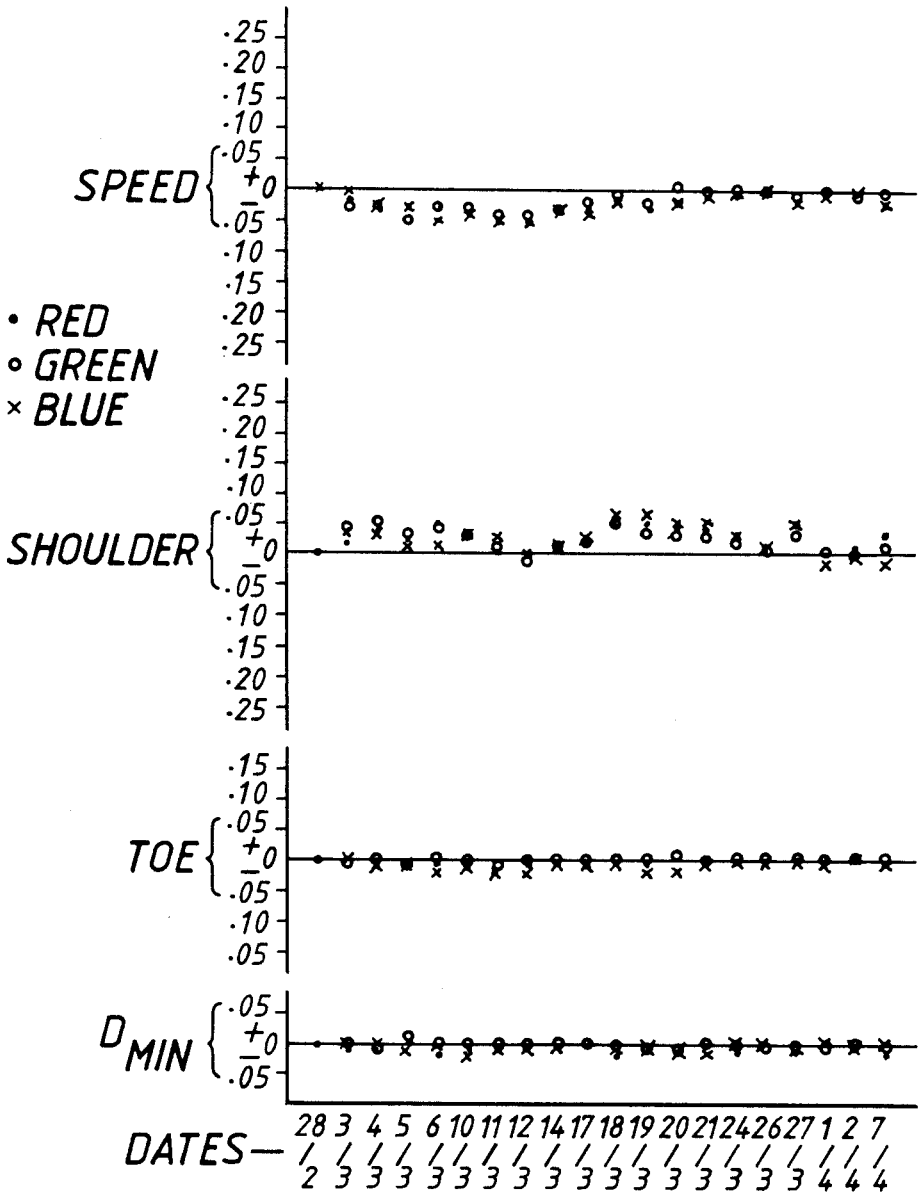
FIGS. 3 and 4 are control plots for seasoning runs for the method of this invention.

21 step exposures on Al-NPl test object (0.1 LogE increment) were made and subsequently kept in a deep freeze. These were used for daily process monitoring and a control plot for this process is shown in FIG. 3. The deviations in speed and shoulder seen early in the run were due to an overestimation of the bromide and CD4 levels needed in the replenisher. These were subsequently corrected to the formula shown in Table 2.

C41 Seasoning Run

The overflow from the above seasoning run was collected and made up to C41 replenisher with the additions shown in Table 3.

TABLE 3

Chemical additons to make C41 replenisher

| Component | Developer (A) Overflow g/l | Additions g/l |
|---|---|---|
| HAS | 2.18 | 0.7 |
| $K_2SO_3$ | 0.41 | 5.2 |
| CD4 | 4.15 | 0.85 |
| NaBr | 0.21 | 0.7 |
| Na Cl | 1.17 | 0.0 |
| SRA | 2.3 | 0.0 |
| $K_2CO_3$ | 28.0 | 9.5 |
| $H_2SO_4$ (ml/conc.) | — | 0.75 |
| AC8 (ml) | 6.5 | 0.0 |
| pH | 10.08 | 10.06 |

Figure 4:
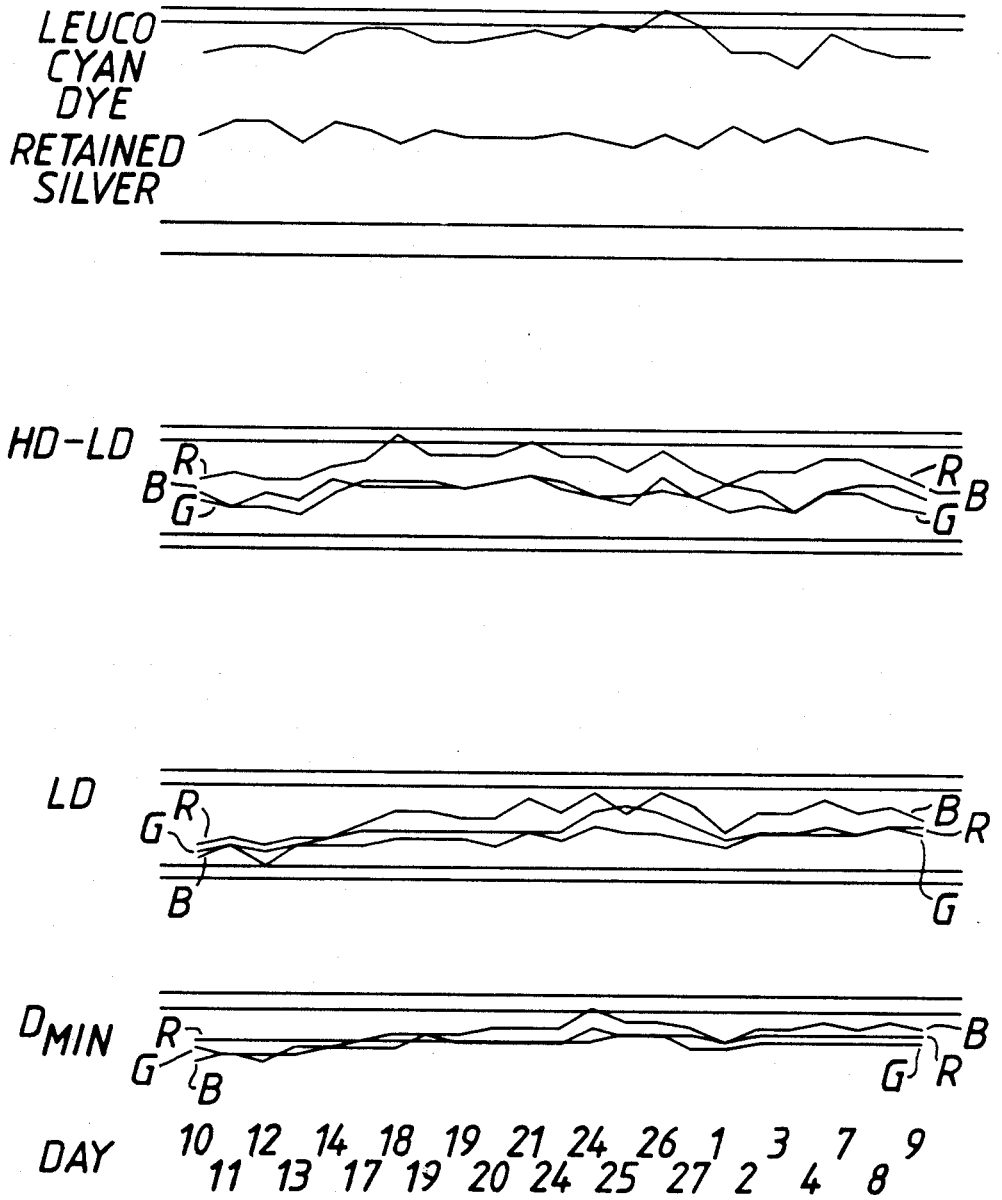

Components such as SRA, and paper seasoning products are not normally present in C41 replenisher and a 25% utilisation seasoning run was carried out to check their effect. A control plot using standard C41 control strips is shown in FIG. 4. The first plot is a measure of leuco cyan dye ($D_{max}$(red)−$D_{max}$(green) and retained silver ($D_{max}$(blue)−$D_{max}$(yellow patch). The second plot of High Density (HD) - Low Density (LD) is a rough measure of contrast. The last two plots are of Low Density and $D_{min}$ respectively. It can be seen that apart from some early deviations the process has run very close to aim. Again these deviations were due to variations in Developer (A) overflow before the replenisher formulation had been correctly tuned.

Tank chemistry was maintained and the analytical data shown in Table 4 correspond to the final day of the control plot.

TABLE 4

C41 Tank Analysis (working developer)

| Component | Concentration g/l | Aim g/l |
|---|---|---|
| pH | 9.98 | 10.0 ± 0.05 |
| Specific Gravity | 1.040 | 1.035 ± 0.03 |
| Total alkalinity* | 27.4 | 24.5 ± 3.0 |
| HAS | 2.08 | 2.0 ± 0.5 |
| $K_2SO_3$ | 4.80 | 5.0 ± 0.19 |
| CD4 | 4.48 | 4.5 ± 0.15 |
| NaBr | 1.29 | 1.30 ± 0.07 |
| NaCl | 1.17 | 0 |
| SRA | 2.3 | 0 |

*Total alkalinity is defined as the mls of 0.1 N sulphuric acid required to titrate a 5 ml sample of the processing solution to pH 4.3.

Example 3

The number of additions necessary to convert paper developer overflow into film replenisher can be reduced by using the paper developer formula in table 5.

TABLE 5

Paper Developer Formula (B)

| Component | Formula | Additions |
|---|---|---|
| Na Br | 0.2 | 0.7 |
| CD4 | 5.1 | 0 |
| $K_2SO_3$ | 0.5 | 5.15 |
| HAS | 2.8 | 0 |
| AC8 (ml) | 6.5 | 0 |
| $K_2CO_3$ | 37.5 | 0 |
| SRA | 2.3 | 0 |
| pH | 10.06 | 0 |

This results in paper sensitometry very close to the original formula of developer (A) in Example 1 and gives an identical film replenisher by means of the additions in Table 5.

Chemical Costs and Effluent Reduction

These numbers are based on the formula shown in this example.

The relative costs are based on current prices (Kodak) and these may vary in the future or with the supplier. The costs and effluent are taken as 100% for the current minilab paper and film processes of RA-4 and C-41. The replenishment rate for various color negative films can be different; in general VR100 and VR200 are the same (41 ml/meter) as are VR400 and VR1000 (58 ml/meter). These values were used to estimate chemical costs and effluent production.

| | No Overflow Use | | | Overflow Use |
|---|---|---|---|---|
| | I RA-4/C-41 | II (B)/C-41 | III (A)/C-41 | IV (B)/"C-41" |
| VR100/200 | | | | |
| Chemical Cost | 100 | 111.6 | 97 | 67.4 |
| Effluent Volume | 100 | 100 | 100 | 51 |
| VR400/1000 | | | | |
| Chemical Cost | 100 | 109.7 | 97.5 | 56 |
| Effluent Volume | 100 | 100 | 100 | 42 |

Case II represents the same formula as in IV but with the overflow going to waste, case III is similar to II but with the paper developer based on C-41 components but optimised for separate use.

Example 4

The number of additions necessary to convert paper developer overflow into film replenisher can be further reduced by using the paper developer formula in table 6 and reduced replenishment rate in the film process.

TABLE 6

Paper Developer Formula (C)

| Component | Formula | Additions |
|---|---|---|
| NaBr | 0.2 | 0 |
| CD4 | 6.7 | 0 |
| $K_2SO_3$ | 0.5 | 6.5 |
| HAS | 3.3 | 0 |
| AC8 (ml) | 6.5 | 0 |

TABLE 6-continued

| Paper Developer Formula (C) | | |
|---|---|---|
| Component | Formula | Additions |
| $K_2CO_3$ | 37.5 | 0 |
| SRA | 2.3 | 0 |
| pH | 10.06 | 0 |

This formula allows the film replenisher to be made by simply adding potassium sulphite to the paper developer overflow. The film replenisher is now different from that mentioned previously in that it is designed to function at a reduced replenishment rate of about 14.5 ml/meter compared to 41 ml/meter of 35 mm perforated color negative film, e.g. VR100. Further savings are thus made.

Example 5

If the paper formula and the film formula are changed by the inclusion of diethylhydroxylamine and a different level of potassium sulphite, then a system in which no additions are necessary to convert paper developer overflow into film replenisher is possible. A paper developer formula/film replenisher and film developer formula are shown in table 7.

TABLE 7

| No Addition Formula (D) | | |
|---|---|---|
| Component | Paper Developer or Film Replenisher g/l | Film Developer g/l |
| NaBr | 0.2 | 1.3 |
| CD4 | 6.7 | 4.5 |
| $K_2SO_3$ | 0.5 | 0.2 |
| HAS | 3.3 | 2.0 |
| Diethyl-hydroxylamine | 8.0 | 5.0 |
| AC8 (ml) | 6.5 | 6.5 |
| $K_2CO_3$ | 37.5 | 37.5 |
| SRA | 2.3 | 2.3 |
| pH | 10.06 | 10.06 |

Both paper and film show sensitometric changes with these formulae which are shown simply to indicate what sort of changes are necessary to make an overflow to which no additions are required to make film replenisher.

The invention has been described in detail with particular reference to preferred embodiments thereof, but it will be understood that variations and modifications can be effected within the spirit and scope of the invention.

What is claimed is:

1. A method of processing photographic silver halide color negative film and color negative paper each through its own color developing solutions wherein the paper color developing solution is replenished and the overflow from this replenished solution is used to replenish the film color developing solution and wherein
   (a) the color paper is based on substantially pure silver chloride emulsions and contains no more than 1% molar silver bromide based on total silver halide and
   (b) both color developing solutions and the replenisher are free from benzyl alcohol.

2. A method as claimed in claim 1 in which the film and paper developer solutions contain the same color developing agent.

3. A method as claimed in claim 1 in which the film and paper developer solutions are both based on 4-amino-N-(2-hydroxyethyl)-3-methyl-aniline sulphate (CD4) as sole color developing agent.

4. A method as claimed in claim 1 in which the overflow from the paper developer solution is mixed with further replenisher components before adding it to the film developer solution.

5. A method as claimed in claim 1 in which the dye image stability of the paper is improved by the addition of a stabiliser to the color paper and/or by the use of a stabiliser in the paper processing line.

6. A method as claimed in claim 1 in which the paper developer solution has a bromide concentration of less than 0.7 g/l (as sodium bromide).

7. The method of claim 4 wherein said paper color developing solution and replenisher formulation have the following compositions:

| Component | Paper Developer (g/l) | Replenisher (g/l) |
|---|---|---|
| NaBr | 0.2 | 0.7 |
| CD4 | 5.1 | 0 |
| $K_2SO_3$ | 0.5 | 5.15 |
| HAS | 2.8 | 0 |
| AC8 (ml) | 6.5 | 0 |
| $K_2CO_3$ | 37.5 | 0 |
| SRA | 2.3 | 0 |
| pH | 10.06 | |

8. The method of claim 4 wherein said paper color developing solution and replenisher formulation have the following compositions:

| Component | Paper Developer (g/l) | Replenisher (g/l) |
|---|---|---|
| NaBr | 0.2 | |
| CD4 | 6.7 | |
| $K_2SO_3$ | 0.5 | 6.5 |
| HAS | 3.3 | |
| AC8 (ml) | 6.5 | 0 |
| $K_2CO_3$ | 37.5 | 0 |
| SRA | 2.3 | 0 |
| pH | 10.06 | |

9. The method of claim 7 wherein the replenishment rate is 41 ml/meter.

10. The method of claim 8 wherein the replenishment rate is 14.5 ml/meter.

11. Process of claim 1 wherein diethylhydroxylamine-containing film and paper developers are used.

12. Process of claim 11 wherein said paper and film developer having the following formulas:

| Component | Paper Developer (g/l) | Replenisher (g/l) |
|---|---|---|
| NaBr | 0.2 | 1.3 |
| CD4 | 6.7 | 4.5 |
| $K_2SO_3$ | 0.5 | 0.2 |
| HAS | 3.3 | 2.0 |
| Diethyl-hydroxylamine | 8.0 | 5.0 |
| AC8 (ml) | 6.5 | 6.5 |
| $K_2CO_3$ | 37.5 | 37.5 |
| SRA | 2.3 | 2.30 |
| pH | 10.06 | 10.06 |

* * * * *